United States Patent [19]

Simpson

[11] Patent Number: 5,025,850

[45] Date of Patent: Jun. 25, 1991

[54] HAIR CRIMPING DEVICE

[76] Inventor: Theresa L. Simpson, P.O. Box 1357, Oak Park, Ill. 60304

[21] Appl. No.: 420,304

[22] Filed: Oct. 12, 1989

[51] Int. Cl.[5] ..... A45D 2/40

[52] U.S. Cl. ..... 132/225; 132/223

[58] Field of Search ..... 132/223, 224, 225, 261, 132/263, 245

[56] References Cited

U.S. PATENT DOCUMENTS

| | | | |
|---|---|---|---|
| 1,591,207 | 7/1926 | Berthelsen | 132/225 |
| 1,682,455 | 8/1928 | Wilson | 132/224 |
| 1,696,823 | 12/1928 | Walsh | 132/225 |
| 2,171,503 | 8/1939 | Huppert | 132/145 |
| 2,377,877 | 6/1945 | Graham | 132/223 |
| 2,781,045 | 2/1957 | Rosch | 132/207 |
| 3,877,471 | 4/1975 | Boyd | 132/223 |
| 4,164,952 | 8/1979 | Banks, Jr. | 132/225 |
| 4,261,375 | 4/1981 | Anderson | 132/224 |
| 4,739,151 | 4/1988 | Smal | 219/225 |
| 4,739,776 | 4/1988 | Prijic | 132/212 |
| 4,867,185 | 9/1989 | Clingen | 132/224 |

FOREIGN PATENT DOCUMENTS

| | | | |
|---|---|---|---|
| 2620912 | 3/1989 | France | 132/223 |

*Primary Examiner*—Gene Mancene
*Assistant Examiner*—Michael Lynch
*Attorney, Agent, or Firm*—Jerry T. Kearns

[57] ABSTRACT

A hair crimping device for use in setting human hair includes a pair of complementary formed triangular wave form members dimensioned for nesting engagement. A base plate is secured to a first tiangular wave form member and includes an elongated projecting handle. A plurality of resilient tabs extend upwardly at opposite ends of the first triangular wave form member and a plurality of apertures are formed in a second trangular wave form member and dimensioned for engagement with the tabs for securing the first and second triangular wave form members in nesting relation. In use, an individual's hair is clamped between the triangular wave form members, thereby assuming a triangular wave form configuration. A plurality of holes are formed through each of the triangular wave form members for establishing fluid communication with hair clamped therebetween.

1 Claim, 3 Drawing Sheets

HAIR CRIMPING DEVICE

BACKGROUND OF THE INVENTION

1. Field of the Invention

The present invention relates to hair crimping devices, and more particularly pertains to a hair crimping device utilized in setting human hair.

2. Description of the Prior Art

Various types of hair crimping and waving devices are known in the prior art. A typical example of such a device is to be found in U.S. Pat. No. 1,696,823, which issued to A. Walsh on Dec. 25, 1928. This patent discloses a hair waver having a base and an elongated handle. A downwardly extending guide member has a generally sinusoidal wave configuration. U.S. Pat. No. 2,171,503, which issued to W. Huppert on Aug. 29, 1939, discloses a hair setting device including interengaging spring biased jaw members. U.S. Pat. No. 2,781,045, which issued to G. Rosch on Feb. 12, 1957, discloses a hair waving device including an elongated rod having a hair clamping member pivotally secured thereto. A plurality of lateral hair engaging projections may extend either from the rod or from the pivotal jaw. U.S. Pat. No. 4,261,375, which issued to D. Anderson on Apr. 14, 1981, discloses a hair curler or crimper for use with permanent waving solution. The device includes first and second hinged sections having alternating upstanding triangular ridges adapted for clamping in facing relation. U.S. Pat. No. 4,739,151, which issued to H. Smal on Apr. 19, 1988, discloses an electrically heated hair crimping tongs including mating triangular wave members.

While the above mentioned devices are directed to hair crimping and waving implements, none of these devices disclose a hair crimping device having first and second triangular wave form members clampable in nesting relation by a plurality of resilient tab members and including an elongated extended handle for manual manipulation. Additionally, none of the aforementioned devices disclose a hair crimping device utilizing nesting triangular wave form members each provided with a plurality of holes for establishing fluid communication with hair clamped therebetween. Inasmuch as the art is relatively crowded with respect to these various types of hair crimping devices, it can be appreciated that there is a continuing need for and interest in improvements to such hair crimping devices, and in this respect, the present invention addresses this need and interest.

SUMMARY OF THE INVENTION

In view of the foregoing disadvantages inherent in the known types of hair crimping devices now present in the prior art, the present invention provides an improved hair crimping device. As such, the general purpose of the present invention, which will be described subsequently in greater detail, is to provide a new and improved hair crimping device which has all the advantages of the prior art hair crimping devices and none of the disadvantages.

To attain this, a representative embodiment of the concepts of the present invention is illustrated in the drawings and makes use of a hair crimping device for use in setting human hair which includes a pair of complementary formed triangular wave form members dimensioned for nesting engagement. A base plate is secured to a first triangular wave form member and includes an elongated projecting handle. A plurality of resilient tabs extend upwardly at opposite ends of the first triangular wave form member and a plurality of apertures are formed in a second triangular wave form member and dimensioned for engagement with the tabs for securing the first and second triangular wave form members in nesting relation. In use, an individual's hair is clamped between the triangular wave form members, thereby assuming a triangular wave form configuration. A plurality of holes are formed through each of the triangular wave form members for establishing fluid communication with hair clamped therebetween.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hair crimping device which has all the advantages of the prior art hair crimping devices and none of the disadvantages.

It is another object of the present invention to provide a new and improved hair crimping device which may be easily and efficiently manufactured and marketed.

It is a further object of the present invention to provide a new and improved hair crimping device which is of a durable and reliable construction.

An even further object of the present invention is to provide a new and improved hair crimping device which is susceptible of a low cost of manufacture with regard to both materials and labor, and which accordingly is then susceptible of low prices of sale to the consuming public, thereby making such hair crimping devices economically available to the buying public.

Still yet another object of the present invention is to provide a new and improved hair crimping device which provides in the apparatuses and methods of the prior art some of the advantages thereof, while simultaneously overcoming some of the disadvantages normally associated therewith.

Still another object of the present invention is to provide a new and improved hair crimping device for enabling waving of hair without application of heat.

Yet another object of the present invention is to provide a new and improved hair crimping device usable with permanent waving solutions.

Even still another object of the present invention is to provide a new and improved hair crimping device which may be efficiently applied and removed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
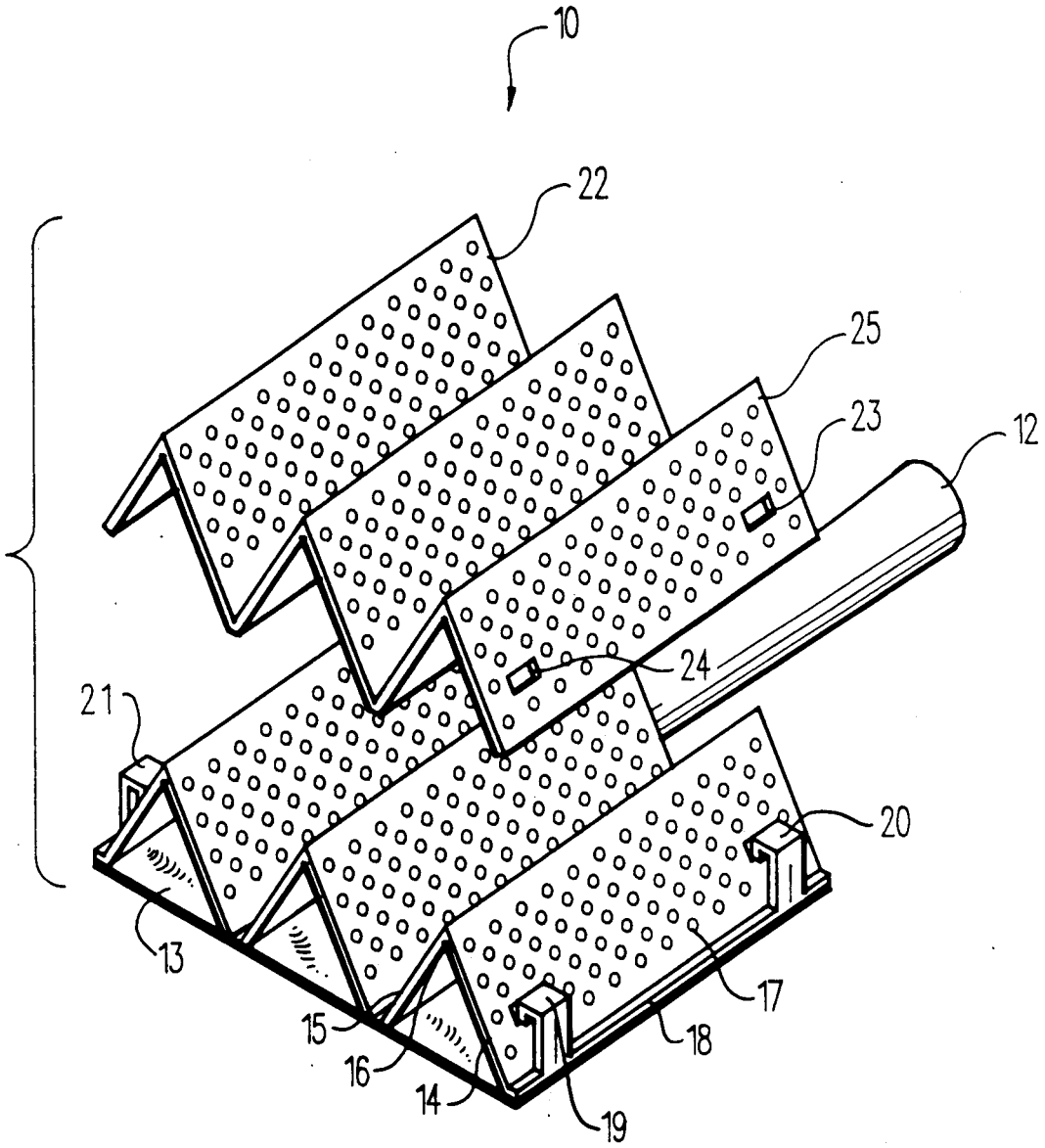
FIG. 1 is an exploded perspective view of the hair crimping device according to the present invention.

With reference now to the drawings, and in particular to FIG. 1 thereof, a new and improved hair crimping device embodying the principles and concepts of the present invention and generally designated by the reference numeral 10 will be described.

More specifically, it will be noted that the first embodiment 10 of the invention includes a handle 12 in the form of an elongated cylindrical member secured to a rectangular base plate 13. A first triangular wave form member is secured to an upper surface of the base plate 13, and is formed by a plurality of rectangular facets 14 and 15 which intersect at an apex line 16. A plurality of holes 17 are formed through each of the rectangular facets to allow fluid communication therethrough. A lateral ridge member 18 extends along each opposite end of the first triangular wave form member secured to the base plate 13, and includes integrally formed resilient tab members 19, 20 and 21. A similar tab member is disposed opposite the tab 20 in spaced relation with the tab 21. A second triangular wave form member 22 is dimensioned for nesting engagement with the first triangular wave form member and is similarly formed by a plurality of angularly intersecting rectangular facets. A plurality of rectangular apertures or recesses 23 and 24 are provided in the second wave form member 22 and are dimensioned for engagement with the resilient tabs 19, 20 and 21. When assembled, a snap type engagement between the resilient tabs and the apertures secures the triangular wave form members together in nesting relation.

Figure 2:
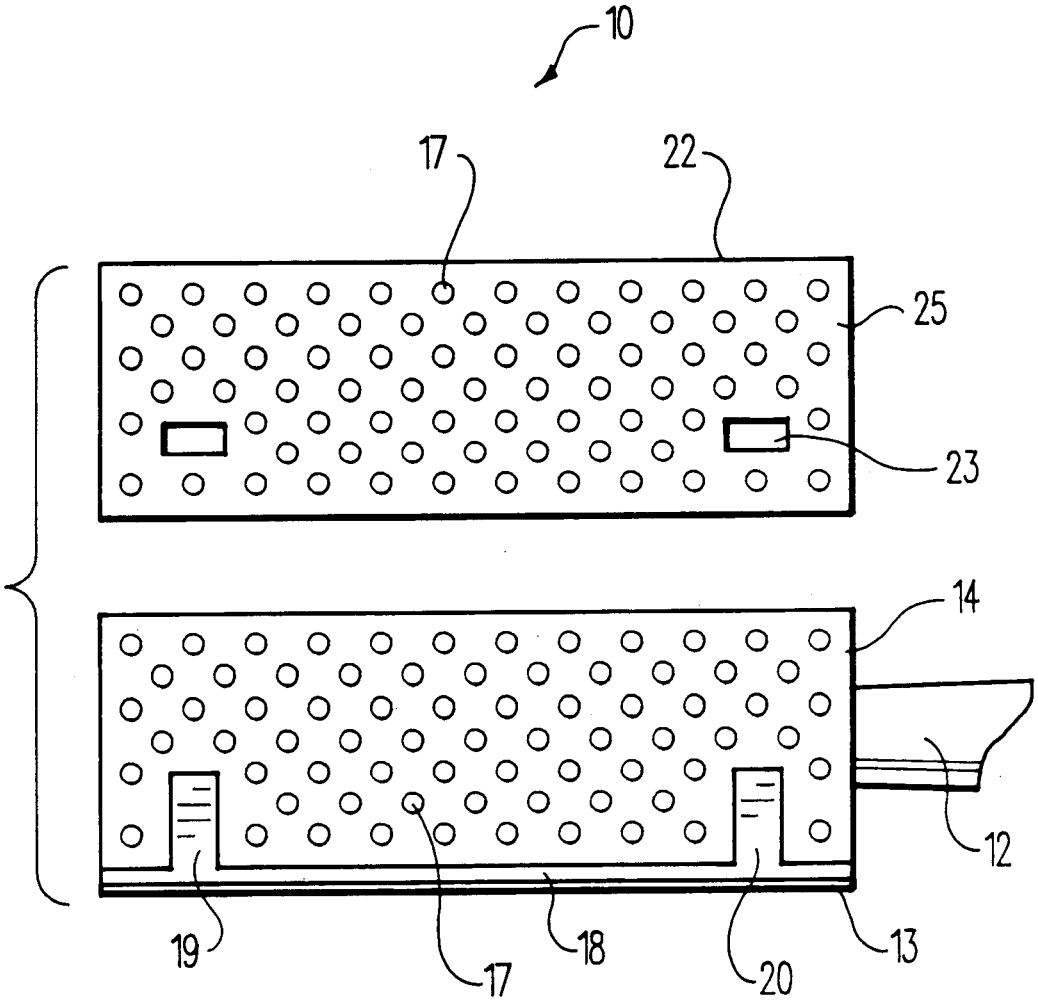
FIG. 2 is an exploded side view of the hair crimping device of the present invention.
Figure 3:
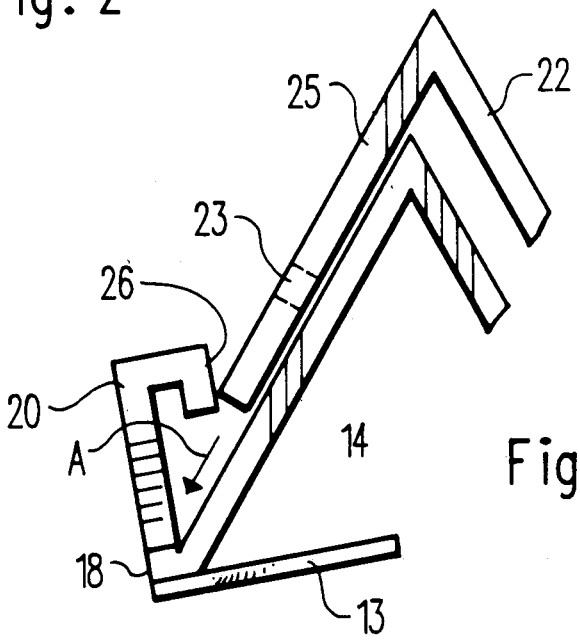
FIG. 3 is a partial end view illustrating the manner of assembly of the first and second triangular wave form members.

FIG. 2 is a side view further illustrating the structure of the present invention. As shown in FIG. 3, each of the resilient tabs, here for example 20, includes a rectangular channel construction forming a downwardly depending tab portion or lug 26, which is dimensioned for frictional engagement with the aperture 23. As the facet 25 of the wave form member 22 is moved manually downwardly in the direction indicated by the arrow A, the resilient tab 20 will deflect outwardly, and the lug portion 26 will subsequently move into snap type engagement with the aperture 23.

Figure 4:
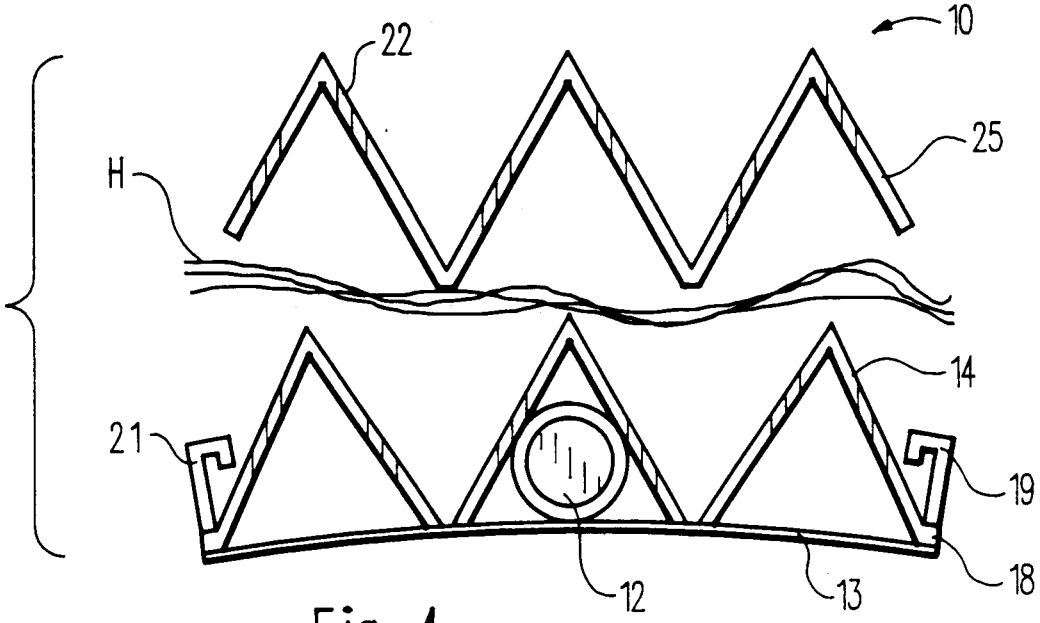
FIG. 4 is an exploded end view illustrating the manner of utilizing the hair crimping device of the present invention.

FIG. 4 is an exploded end view which illustrates the manner of use of the hair crimping device of the present invention. The hair H of an individual is placed between the wave form members 22 and the wave form member mounted on the base plate 13. The base plate 13 and wave form member 22 are moved together.

Figure 5:
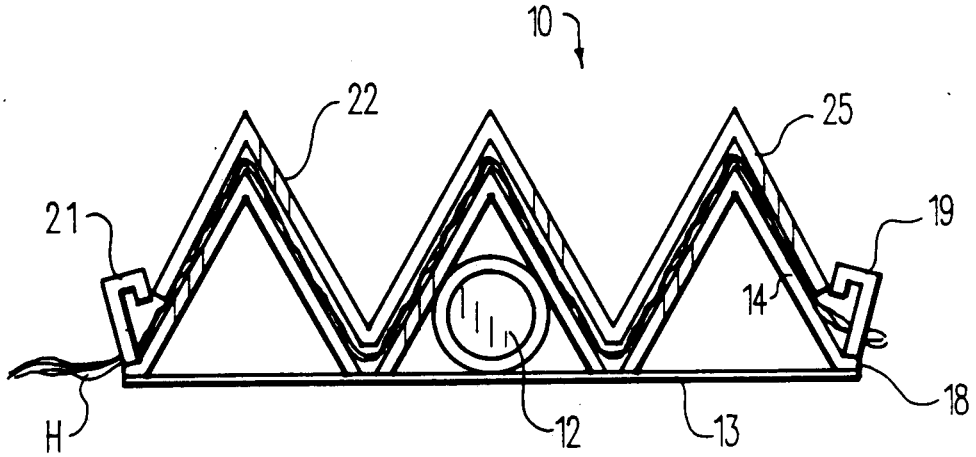
FIG. 5 is an additional end view, further illustrating the manner of use of the hair crimping device of the present invention.

As illustrated in FIG. 5, this results in the hair H adopting a triangular wave form configuration. Continued downward movement of the triangular wave form member 22 results in snap type engagement of the resilient tabs 19 and 21 with the previously described apertures formed in the wave form member 22. This provides a secure clamping engagement for retaining the hair H until set.

The hair crimping device of the present invention, enables a hair waving operation to be formed without the application of hair damaging heat, and may be used in conjunction with permanent waving solutions to achieve an attractive and lasting effect.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A hair crimping device, comprising:

a pair of complementary formed triangular wave form members dimensioned for nesting engagement;

a base plate secured to a first of said triangular wave form members;

an elongated handle secured to said base plate;

a plurality of holes formed through each of said triangular wave from members for fluid communication with hair clamped therebetween.

a plurality of resilient tabs extending upwardly at opposite ends of said first triangular wave from member, said tabs attached to said first triangular wave form member at a position of substantially minimum vertical elevation adjacent said base plate;

each of said tabs having an upper end with a rectangular channel construction forming a downwardly depending lug; and a plurality of rectangular aperture formed in inclined rectangular facets of a second of said triangular wave form members, said apertures dimensioned for engagement with said lugs, said tabs disposed so as to be deflected outwardly by downward movement of said second wave form member until engagement of said downwardly depending lugs in said apertures for securing said triangular wave form members in nesting relation.

* * * * *